US009538288B2

(12) United States Patent
Tawada

(10) Patent No.: US 9,538,288 B2
(45) Date of Patent: Jan. 3, 2017

(54) SOUND FIELD CORRECTION APPARATUS, CONTROL METHOD THEREOF, AND COMPUTER-READABLE STORAGE MEDIUM

(71) Applicant: CANON KABUSHIKI KAISHA, Tokyo (JP)

(72) Inventor: Noriaki Tawada, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 29 days.

(21) Appl. No.: 14/592,954

(22) Filed: Jan. 9, 2015

(65) Prior Publication Data

US 2015/0208169 A1 Jul. 23, 2015

(30) Foreign Application Priority Data

Jan. 21, 2014 (JP) ..... 2014-008856

(51) Int. Cl.
*H04R 3/04* (2006.01)
*H04R 5/04* (2006.01)

(52) U.S. Cl.
CPC *H04R 3/04* (2013.01); *H04R 5/04* (2013.01); *H04R 2430/03* (2013.01)

(58) Field of Classification Search
CPC ..... H04R 3/04; H04R 5/04; H04R 2430/03
USPC ..... 381/303, 103, 101, 98
See application file for complete search history.

(56) References Cited

U.S. PATENT DOCUMENTS 6,072,879 A * 6/2000 Ouchi ..... H03G 9/00 381/103
2005/0244012 A1* 11/2005 Asada ..... H04S 7/301 381/56
2008/0037805 A1* 2/2008 Kino ..... H03G 5/165 381/101
2009/0274307 A1* 11/2009 Yoshino ..... H04S 7/301 381/1
2012/0063605 A1* 3/2012 Tawada ..... H04S 7/305 381/56

FOREIGN PATENT DOCUMENTS

JP 3556427 B2 8/2004

* cited by examiner

*Primary Examiner* — David Ton
(74) *Attorney, Agent, or Firm* — Carter, DeLuca, Farrell & Schmidt, LLP

(57) ABSTRACT

An impulse response between a sound-producing source and a listening point in an acoustic space is measured. A frequency characteristic serving as the processing target of sound field correction is derived from the impulse response. A level difference at a boundary frequency between a level representing a low frequency band and a level representing middle and high frequency bands is calculated for the low frequency band equal to or lower than the boundary frequency and the middle and high frequency bands higher than the boundary frequency in the frequency characteristic. The level of a target characteristic in the low frequency band in the frequency characteristic is decided to set the level difference after sound field correction to be equal to or smaller than a predetermined value.

11 Claims, 6 Drawing Sheets

SOUND FIELD CORRECTION APPARATUS, CONTROL METHOD THEREOF, AND COMPUTER-READABLE STORAGE MEDIUM

BACKGROUND OF THE INVENTION

Field of the Invention

The present invention relates to a sound field correction technique of correcting the influence of the interference between a plurality of sound waves on the frequency characteristic in an acoustic space so as to obtain a target characteristic.

Description of the Related Art

When a sound is produced from a sound-producing source such as a speaker in a space having wall surfaces such as a wall, floor, and ceiling in a room of a house, sounds reflected by the respective surfaces of the room in addition to the direct sound reach a sound capture point in the space, and a plurality of sound waves interfere with each other. In general, the resonance phenomenon in the room mode (natural vibration mode having features such as the transmission characteristic of a room depending on the dimensions of the room) occurs at frequencies corresponding to the dimensions of the room. This phenomenon is called a standing wave. Even when no wall surface exists in a space, if a plurality of sound-producing sources are used, direct sounds may interfere with each other.

In this manner, when a plurality of sound waves interfere with each other, the interference greatly influences the frequency characteristic at a sound capture point. More specifically, when a microphone is located at the sound capture point and a measurement signal is produced from the sound-producing source to measure an impulse response between the sound-producing source and the sound capture point, peaks and dips are generated on the graph of the amplitude-frequency characteristic (dB expression of this characteristic will be called an "f characteristic" hereinafter). Especially in a low frequency band in which the influence of the room mode prevails, large peaks and dips appear on the f characteristic.

In this case, when the sound-producing source is a speaker, the sound capture point is a listening point, and the user listens to music in the room, the sound quality in audibility is greatly degraded such that the volume of a sound of a peak frequency excessively increases and causes booming, whereas a sound is omitted at a dip frequency. Therefore, a sound field correction technique of applying a filter to a reproduce signal to cancel large peaks and dips on the f characteristic of the impulse response and improve the sound quality becomes important.

FIG. 5A shows the f characteristics of a total of nine impulse responses corresponding to three sound-producing patterns (only L, only R, and L+R) between stereo speakers and three points in a listening area including a listening point in given room A. In FIG. 5A, the boundary between the low frequency band and the middle and high frequency bands is set to be 200 Hz. Especially in the low frequency band, the influence of the room mode prevails, and steep peaks and dips are generated on each f characteristic.

It is generally known that the shape of the f characteristic and the human audibility do not always coincide with each other in the low frequency band, but they match well in the middle and high frequency bands. For this reason, sound field correction is not always necessary for the middle and high frequency bands, and there is a choice of not performing correction is possible. However, sound field correction is basically necessary for the low frequency band in order to cancel steep peaks and dips. In Japanese Patent No. 3556427, when sound field correction is performed using an adaptive filter, the calculation amount is reduced by performing correction in only the low frequency band in which the f characteristic or group delay characteristic of the impulse response is disturbed.

FIG. 6 is a graph showing an example of the design of a sound field correction filter for the low frequency band of the f characteristic in FIG. 5A. An average f characteristic 601 before correction indicated by a thick dotted line is an f characteristic obtained by averaging the low frequency band portions, each as the target frequency band of sound field correction, of the nine f characteristics in FIG. 5A. The average level of the average f characteristic 601 before correction is set as a correction target level 602 indicated by a horizontal line in FIG. 6. The sound field correction filter is designed to suppress, toward the correction target level 602, steep peaks and dips on the average f characteristic 601 before correction.

For example, a biquadratic IIR (Infinite Impulse Response) peak filter capable of implementing a steep filter characteristic by a small processing amount is suitable as a filter for canceling steep peaks and dips. Peak filters that set negative and positive filter gains are assigned to respective peaks and dips on the average f characteristic 601 before correction. These peak filters are series-connected into an overall sound field correction filter. The thus-designed sound field correction filter has a correction filter f characteristic 603 indicated by a thick solid line. The correction filter f characteristic 603 is applied to the average f characteristic 601 before correction, obtaining an average f characteristic 604 after correction similarly indicated by a thick solid line. This sound field correction filter is designed not to completely raise a dip or completely lower a peak to the correction target level 602, in order to avoid excessive correction. Hence, the average f characteristic 604 after correction has a gradual undulation near the correction target level 602, but steep peaks and dips that cause a problem in audibility are canceled.

Each f characteristic in FIG. 5B is obtained by applying the correction filter f characteristic 603 to each f characteristic in FIG. 5A, and steep peaks and dips are suppressed, as in the average f characteristic 604 after correction in FIG. 6. When attention is paid to the balance of the whole f characteristic including not only the low frequency band but also the middle and high frequency bands, each f characteristic in FIG. 5B has good balance between the low frequency band and the middle and high frequency bands. More specifically, the average level of the respective f characteristics in the low frequency band is drawn as a horizontal line in the low frequency band of FIG. 5B, and the approximate straight lines (approximate characteristics) of the respective f characteristics in the middle and high frequency bands are drawn as downward sloping lines in the middle and high frequency bands. Then, at the 200-Hz boundary between the low frequency band and the middle and high frequency bands, the horizontal line of the average level of the respective f characteristics in the low frequency band and the approximate straight lines in the middle and high frequency bands are smoothly connected without a large level difference, as indicated by a circled portion. When an audition experiment was conducted in a state in which the low frequency band and middle and high frequency bands of each f characteristic were balanced, as shown in FIG. 5B, a good audibility result was obtained.

In contrast, FIG. 3A shows a total of nine impulse response f characteristics at three points in a listening area, as in room A, as for another room B different from the room for FIG. 5A. In the low frequency band of 200 Hz or lower, the influence of the room mode is weaker than that in room A, and peaks and dips on each f characteristic are not so larger than those in FIG. 5A. However, when attention is paid to the balance between the low frequency band and the middle and high frequency bands, a steep step is generated between the low frequency band and the middle and high frequency bands, as indicated by a circled portion in FIG. 3A, unlike room A. The level in the low frequency band is much higher than that in the middle and high frequency bands.

FIG. 4A shows an example of the design of a sound field correction filter for the low frequency band of the f characteristic in FIG. 3A by the same method as that described with reference to FIG. 6. A correction filter f characteristic 403 of the designed sound field correction filter is applied to an average f characteristic 401 before correction, obtaining an average f characteristic 404 after correction. The correction filter f characteristic 403 is applied to each f characteristic in FIG. 3A, obtaining each f characteristic in FIG. 3B. This f characteristic reveals that peaks and dips in the low frequency band are suppressed. However, in terms of the balance between the low frequency band and the middle and high frequency bands, the steep step between the low frequency band and the middle and high frequency bands shown in FIG. 3A still remains even in FIG. 3B after sound field correction.

When an audition experiment was conducted in a state in which the level of each f characteristic in the low frequency band was much higher than that in the middle and high frequency bands owing to a step as in FIG. 3B, the user excessively felt the low frequency band, and the audibility was greatly impaired. It is considered that even when peaks and dips in the low frequency band, which may generate a problem in audibility in general, are canceled, if the balance between the low frequency band and the middle and high frequency bands is poor, the audibility is impaired.

The method in Japanese Patent No. 3556427 cancels the disturbances of the f characteristic and group delay characteristic in the low frequency band, but does not consider the balance between the low frequency band and the middle and high frequency bands. Further, the following problem arises even in a method of introducing a filter other than the sound field correction filter in order to cancel a steep step between the low frequency band and the middle and high frequency bands, as in room B.

Ideally, a filter for canceling a steep step and adjusting the level in the low frequency band to the level in the middle and high frequency bands has a gain of 0 dB for the middle and high frequency bands and a negative gain corresponding to the step size for the low frequency band, and has a characteristic in which the gain abruptly changes at the boundary between the low frequency band and the middle and high frequency bands.

However, a great many taps are necessary to implement, by an FIR (Finite Impulse Response), a filter having a steep characteristic at a relatively low frequency. Owing to the convolution processing amount, other acoustic processes such as tone control, loudness equalization, and a compressor are hindered. If the number of taps is decreased, the characteristic becomes moderate at a portion where a steep characteristic is required, and a new peak or dip is generated at the boundary between the low frequency band and the middle and high frequency bands. For example, even when a low-shelf IIR is used, if a steep characteristic is implemented at a low frequency, the filter characteristic is disturbed at the boundary between the low frequency band and the middle and high frequency bands.

When the speaker is a multi-way speaker having a plurality of diaphragms for respective bands, the balance between the low frequency band and the middle and high frequency bands may be adjusted by adjusting the gain of a woofer in charge of the low frequency band. However, the crossover frequencies of the woofer and a squawker in charge of the middle and high frequency bands hardly coincide with the frequency of a steep step to be canceled. Even if these frequencies coincide with each other, crossover filters for band division have been applied to the woofer and the squawker. For this reason, the synthesis of the woofer and squawker after gain adjustment becomes the synthesis problem of the crossover filter having a step. A steep step corresponding to the gain adjustment amount cannot be simply implemented at the crossover frequency, and new peaks and dips are generated after all.

In this manner, when a steep step remains in the f characteristic after sound field correction, it is difficult to clearly cancel the steep step by another filter or the like. Considering that a peak filter also having a steep characteristic is used to cancel steep peaks and dips on the f characteristic in the low frequency band in sound field correction, this peak filter may also be used to cancel a steep step between the low frequency band and the middle and high frequency bands.

SUMMARY OF THE INVENTION

The present invention provides a sound field correction technique capable of balancing the low frequency band and the middle and high frequency bands while suppressing peaks and dips on the f characteristic in the low frequency band.

To achieve the above object, a sound field correction apparatus according to the present invention has the following arrangement.

That is, a sound field correction apparatus that corrects influence of interference between a plurality of sound waves on a frequency characteristic in an acoustic space to obtain a target characteristic, comprising: a measurement unit configured to measure an impulse response between a sound-producing source and a listening point in the acoustic space; a derivation unit configured to derive, from the impulse response, a frequency characteristic serving as a processing target of sound field correction; a calculation unit configured to calculate a level difference at a boundary frequency between a level representing a low frequency band and a level representing middle and high frequency bands for the low frequency band not higher than the boundary frequency and the middle and high frequency bands higher than the boundary frequency in the frequency characteristic; and a decision unit configured to decide a level of a target characteristic in the low frequency band in the frequency characteristic to set the level difference after sound field correction to be not larger than a predetermined value.

According to the present invention, the low frequency band and the middle and high frequency bands can be balanced while peaks and dips on the f characteristic in the low frequency band are suppressed.

Further features of the present invention will become apparent from the following description of exemplary embodiments (with reference to the attached drawings).

DESCRIPTION OF THE EMBODIMENTS

An embodiment of the present invention will now be described in detail with reference to the accompanying drawings. The arrangement in the following embodiment is merely an example, and the present invention is not limited to the illustrated arrangement.

The embodiment will explain a sound field correction apparatus that corrects the influence of the interference between a plurality of sound waves on the frequency characteristic in an acoustic space so as to obtain a target characteristic.

Figure 1:
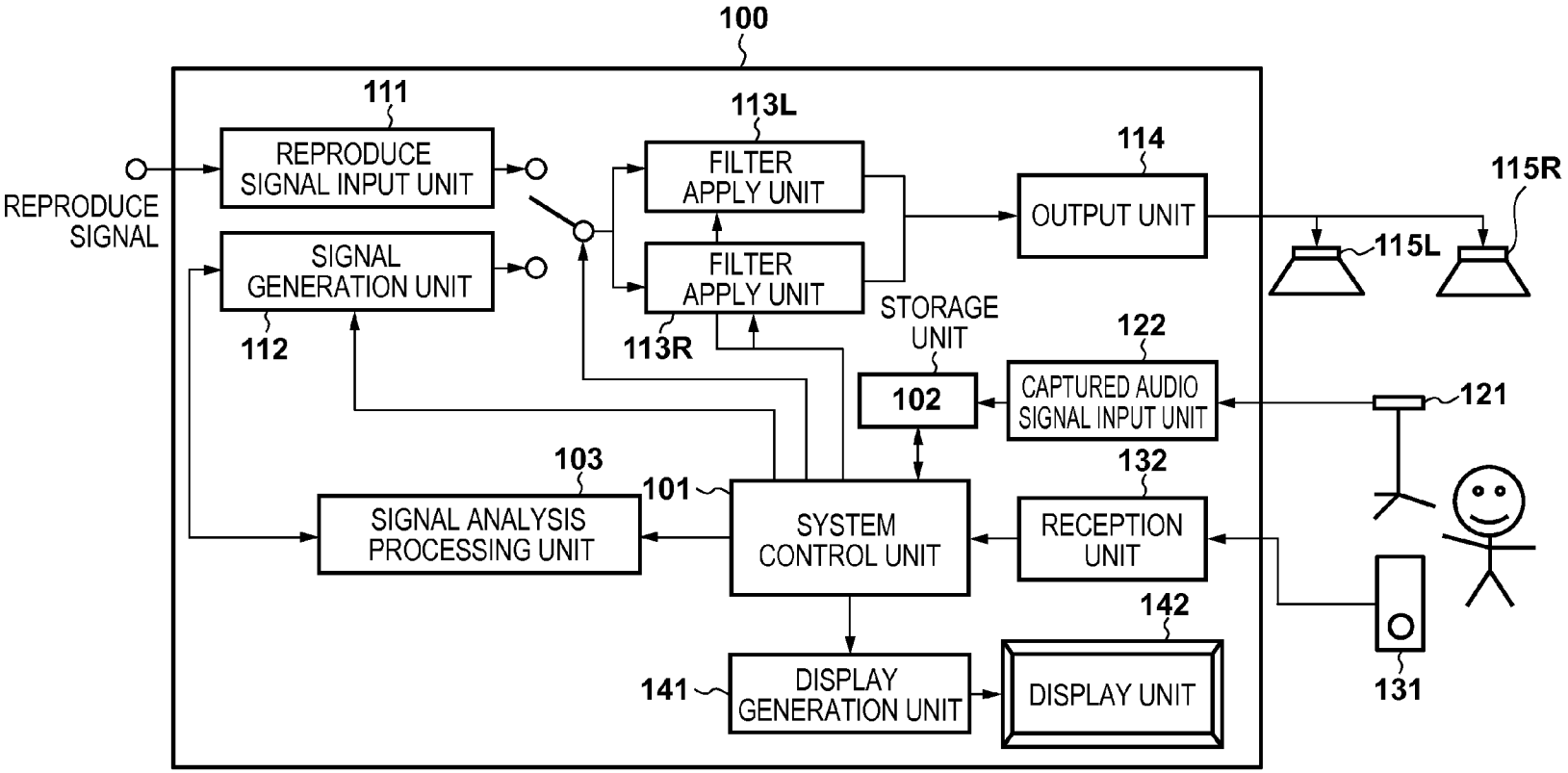
FIG. 1 is a block diagram showing a sound field correction apparatus according to an embodiment.

FIG. 1 is a block diagram showing a sound field correction apparatus according to the embodiment.

The sound field correction apparatus shown in FIG. 1 includes, in a controller 100, a system control unit 101 that performs the overall control, a storage unit 102 that stores various data, and a signal analysis processing unit 103 that performs analysis processing of a signal. As components for implementing the function of a reproduce system (reproduce unit), the sound field correction apparatus includes a reproduce signal input unit 111, a signal generation unit 112, filter apply units 113L and 113R, an output unit 114, and speakers 115L and 115R serving as sound-producing sources. As components for implementing the function of a sound capture system (sound capture unit), the sound field correction apparatus includes a microphone 121 and a captured audio signal input unit 122.

Further, as components for accepting a command input from the user, the sound field correction apparatus includes a remote controller 131 and a reception unit 132. As components for presenting information to the user, the sound field correction apparatus includes a display generation unit 141 and a display unit 142. Although not shown for simplicity, assume that the signal analysis processing unit 103, the signal generation unit 112, the filter apply units 113L and 113R, and the display generation unit 141 are mutually connected to the storage unit 102.

Note that various building components of the sound field correction apparatus in FIG. 1 may be implemented using all or some of various building components of a general-purpose computer such as a CPU, ROM, and RAM, or may be implemented using hardware, software, or a combination of them.

The reproduce signal input unit 111 receives a reproduce signal from a sound source reproduce apparatus such as a CD player, and when the reproduce signal is an analog signal, A/D-converts the signal for subsequent digital signal processing. As a signal to be transmitted to the filter apply units 113L and 113R, either a reproduce signal from the reproduce signal input unit 111 or a signal generated by the signal generation unit 112 is selected. The signals processed by the filter apply units 113L and 113R are transmitted to the output unit 114, D/A-converted and amplified by it, and then produced as sounds from the speakers 115L and 115R.

In the case of an active speaker, the output unit 114 and the speakers 115L and 115R are combined into one component. The captured audio signal input unit 122 receives a captured audio signal from the microphone 121, amplifies the signal, and A/D-converts it for subsequent digital signal processing. At this time, the microphone 121 and the remote controller 131 may be integrated as one input device. The display unit 142 need not always be incorporated in the form of a display panel or the like in the controller 100, and an external display device such as a display may be connected.

The operation of the sound field correction apparatus will be explained in detail below.

First, the user transmits a "sound field correction start" command from the remote controller 131 to the controller 100. The reception unit 132 receives the command, and the system control unit 101 analyzes it. Information corresponding to the current state of a sound field correction sequence is generated by the display generation unit 141, displayed by the display unit 142, and presented to the user. In this case, the user is first instructed about necessary work contents of setting the microphone 121 at a listening point where he listens to music, and after making preparations, pressing the "OK" button of the remote controller 131.

In general, the height of a microphone for performing measurement is desirably the height (about 1 m) of the ear when the user sits and listens to music. Note that not all these work contents need be displayed on the display unit 142, and it is also possible to display only minimum information representing the current state in an easy-to-understand manner, and give a detailed explanation by a paper manual or the like. The information presentation and instruction to the user need not always be performed visually by using the display generation unit 141 and the display unit 142. Instead, a voice of the same contents may be generated by the signal generation unit 112 and produced as a voice guide from the speakers 115L and 115R.

When the user sets the microphone 121 at the listening point and presses the "OK" button of the remote controller 131, the display unit 142 presents a display "perform measurement at a measurement point 1/L" representing measurement of an impulse response between the speaker 115L and the listening point.

In measurement of the impulse response, the system control unit 101 mainly acts to perform sound production and sound capture of measurement signals. First, signals for measuring an impulse response, such as MLS (Maximum Length Sequence) and TSP (Time-Stretched Pulse), are prepared. These measurement signals can be generated by simple numerical expressions, but need not always be generated by the signal generation unit 112 on the site, and may be stored in advance in the storage unit 102 and only be read out.

The latter one of the reproduce signal input unit 111 and signal generation unit 112 is selected, and the current target speaker 115L out of the speakers 115L and 115R produces a sound of the measurement signal. The measurement signal need not be processed by the filter apply unit 113L in particular, and may directly pass through it. However, considering that the f characteristic of the random noise component of background noise slopes downward, the filter apply unit 113L may add, for example, a pink noise characteristic to the measurement signal. At the same time as the start of sound production of the measurement signal, a sound picked up by the microphone 121 is stored as a captured audio signal in the storage unit 102. That is, the sound of the measurement signal produced as a sound wave is captured by the microphone 121 and recorded in a state in which the characteristics of the speaker 115L and room (acoustic space) are convoluted.

Then, the signal analysis processing unit 103 calculates an impulse response from the measurement signal and the captured audio signal. Since the measurement signal such as MLS or TSP has a property in which it becomes an impulse at the autocorrelation $\tau=0$, calculation of a cross-correlation with a captured audio signal corresponds to calculation of an impulse response. In general, the cross-correlation is calculated in the frequency domain by using fast Fourier transform (FFT). However, for MLS, fast Hadamard transform (FHT) is usable instead of FFT. Note that when the filter apply unit 113L or 113R adds a pink noise characteristic or the like at the time of producing the sound of a measurement signal, the pink noise characteristic or the like is removed from the captured audio signal based on the opposite characteristic before calculation of the cross-correlation.

The calculated impulse response is saved in the storage unit 102 in association with the measurement point number (1=listening point) and the sound-producing pattern (L) of the speaker 115L.

Subsequently, the display unit 142 presents a display "perform measurement at a measurement point 1/R" representing measurement of an impulse response between the speaker 115R and the listening point. Only the speaker 115R outputs a produced audio signal, and processing up to calculation and save of an impulse response is performed in the above-described way.

Since the influence of a standing wave in the room mode changes depending on the position, the appearances of peaks and dips on the f characteristic serving as the main target of sound field correction also change depending on the position. If the user stands still alone, it suffices to perform sound field correction in consideration of the characteristic of only one listening point. In practice, however, the user may move his head, or a plurality of users may listen to music at the same time. In such a case, sound field correction may impair the audibility adversely at a point off the listening point. It is therefore desirable to measure impulse responses at several points within the listening area in addition to the listening point on the premise of a listening area of a certain extent (predetermined range) around the listening point in accordance with the range where the user can exist.

By performing sound field correction in consideration of characteristics at a plurality of points within the listening area including the listening point, the audibility can be improved on average in the entire listening area. For example, assume that the position of the microphone is changed in order and impulse responses are measured even at measurement point 2 and measurement point 3 near the listening point subsequently to measurement at the listening point (measurement point 1). That is, a total of six impulse responses 1/L, 1/R, 2/L, 2/R, 3/L, and 3/R have been saved as a plurality of impulse responses in the storage unit 102 by the end of measurement.

Figure 2:
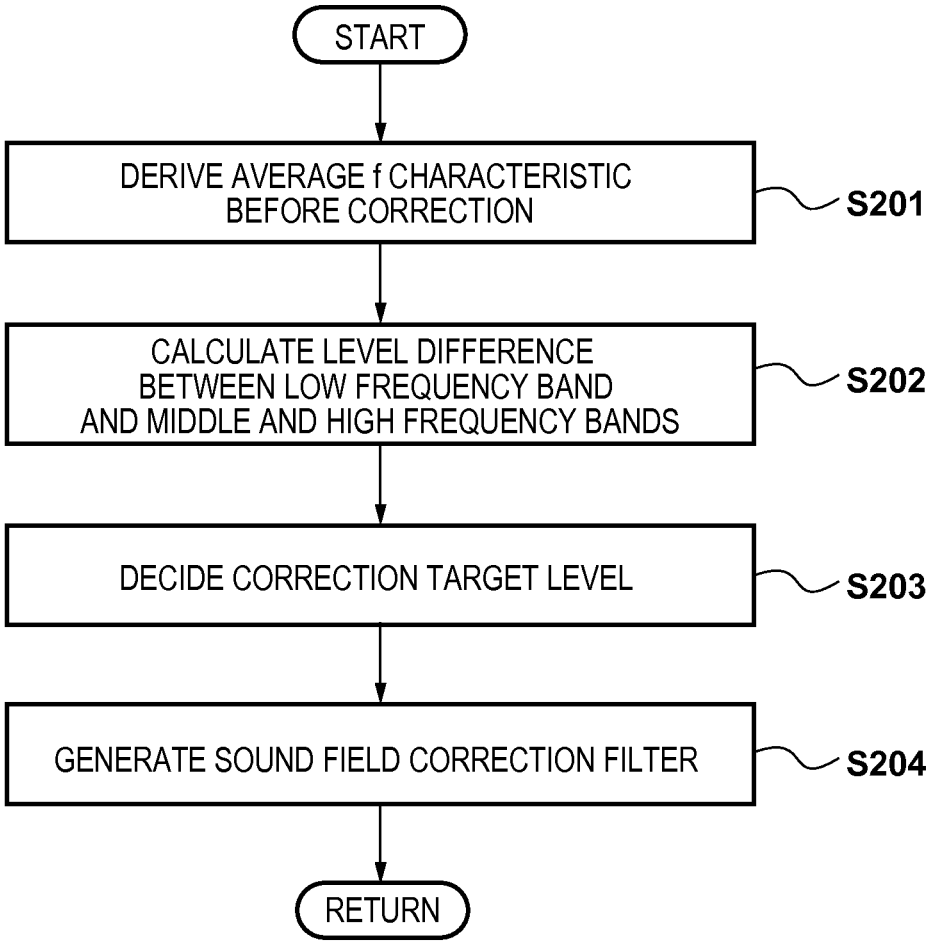
FIG. 2 is a flowchart showing the design of a sound field correction filter according to the embodiment.

The design of a sound field correction filter by the signal analysis processing unit 103 will be described in detail below with reference to the flowchart of FIG. 2. Note that the processing in FIG. 2 can be implemented when, for example, the system control unit 101 reads out and executes a program stored in the storage unit 102.

First, in step S201, the signal analysis processing unit 103 derives a single f characteristic (frequency characteristic) serving as the processing target of sound field correction from a plurality of impulse responses saved in the storage unit 102.

Impulse responses are actually measured at respective measurement points by using the sound-producing pattern of only the speaker 115L or 115R. Each of them corresponds to a transmission characteristic between the speaker and the measurement point when music to be reproduced is constituted by monophonic signals of only Lch or only Rch. However, the transmission characteristic at the time of reproducing general music is obtained by coupling transmission characteristics for only L and only R in accordance with the state of a music signal at each timing. Therefore, an impulse response 1/L+R at a listening point corresponding to a case in which Lch and Rch are equal is calculated by simple addition of 1/L and 1/R. By using impulse responses corresponding to three sound-producing patterns of only L, only R, and L+R for one measurement point, a sound field correction filter suited to an actual state at the time of reproducing music can be designed. Here, a total of nine impulse responses, that is, 1/L+R, 2/L+R, and 3/L+R in addition to six actually measured impulse responses are used.

Generally, the main purpose of sound field correction is to cancel large peaks and dips on the f characteristic that are generated owing to excessive influence of the room mode (normal vibration mode: natural vibration mode having features such as the transmission characteristic of a room depending on the dimensions of the room) in the low frequency band in which the shape of the f characteristic corresponds to the human audibility, and that cause a problem in audibility. Thus, a frequency at which the frequency band is divided into a low frequency band and middle and high frequency bands is set as a boundary frequency, and the low frequency band equal to or lower than this boundary frequency is defined as the target frequency band of sound field correction. The boundary frequency may be a predetermined value, or a Schroeder frequency considered to give a boundary between the low frequency band and the middle and high frequency bands may be calculated. In the latter case, the boundary frequency is calculated using the rough capacity of a room that has been input by the user, and the reverberation time of the room that has been calculated from impulse responses. In the following description, the boundary frequency is 200 Hz.

By performing FFT processing on the respective impulse responses, respective complex Fourier coefficients are obtained. The respective impulse responses have different sizes in accordance with the attenuation corresponding to the distances between the speakers 115L and 115R and each measurement point, the sound-producing patterns of the speakers 115L and 115R, and the like. Since the purpose of sound field correction is to correct the shapes of peaks and dips on each f characteristic in the target frequency band, normalization is performed to uniform their sizes in the target frequency band. For example, normalization is performed by calculating the average value of the absolute values (amplitudes) of the respective complex Fourier coefficients in the target frequency band, and dividing the respective complex Fourier coefficients by the average value serving as a normalization coefficient. Although the upper limit frequency of the target frequency band is the boundary frequency of 200 Hz, the lower limit frequency is also defined in accordance with the low frequency band reproduce capability of the speakers 115L and 115R. In this case, the target frequency band of sound field correction is set to be 20 to 200 Hz.

To obtain an average amplitude-frequency characteristic from the respective complex Fourier coefficients, it suffices to average respective amplitude-frequency characteristics. At this time, not only simple averaging of the respective amplitude-frequency characteristics, but also weighted averaging of increasing the weight of the listening point may be performed. A single amplitude-frequency characteristic obtained in this fashion is set as an average amplitude-frequency characteristic.

The average amplitude-frequency characteristic has small disturbances even upon averaging, so smoothing is performed in the frequency axis direction. When smoothing is performed on a linear frequency axis, the width of the moving average is designated by the frequency or the number of samples corresponding to the frequency. When octave smoothing is performed on a logarithmic frequency axis, the degree of smoothing can be adjusted by designating an octave width such as 1/12 octave. However, for filter generation, data interpolation is performed on the logarithmic frequency axis in accordance with the linear frequency axis after octave smoothing. In either smoothing, it is adjusted to leave the features of peaks and dips on the f characteristic. The smoothed average amplitude-frequency characteristic is expressed by dB, and this expression will be called an average f characteristic before correction. Note that the order of smoothing and dB expression may be reversed.

Figure 3A:
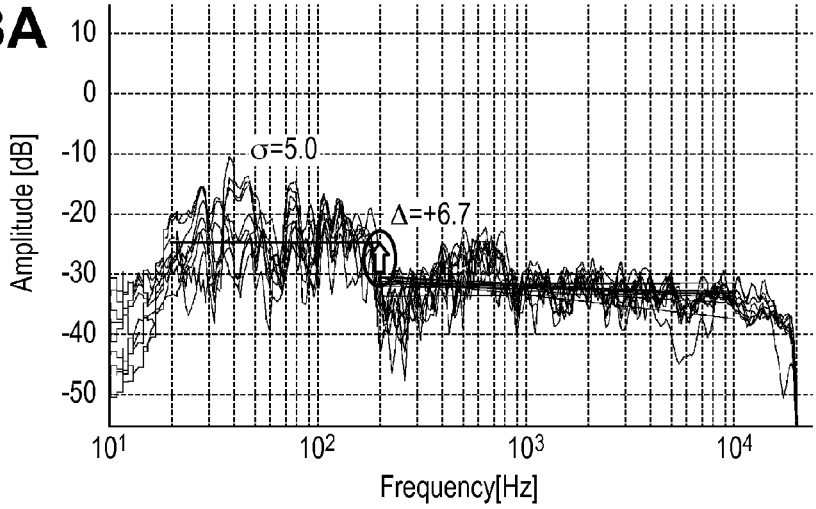
FIGS. 3A to 3C are graphs for explaining the balance of the f characteristic between the low frequency band and the middle and high frequency bands in given room B according to the embodiment.
Figure 4A:
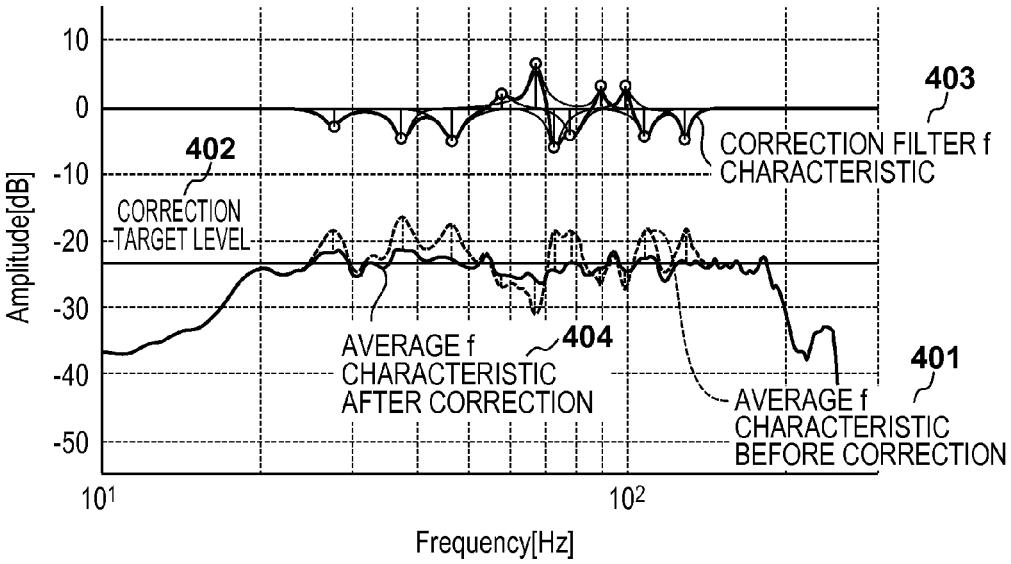
FIGS. 4A and 4B are graphs for explaining an example of the design of a sound field correction filter in given room B according to the embodiment.
Figure 4B:
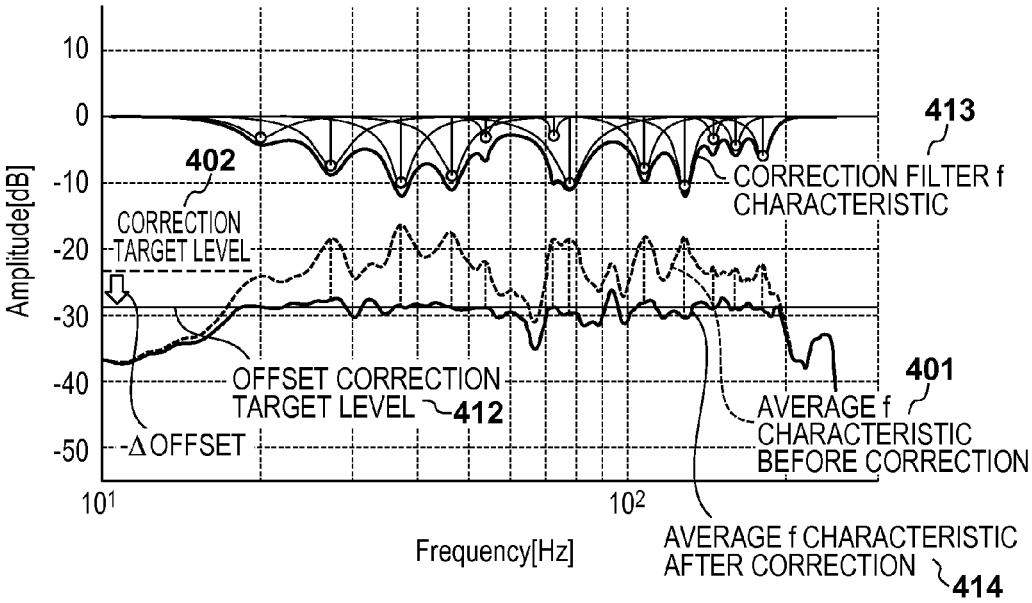

In FIG. 3A, a total of nine impulse responses in given room B are drawn after performing octave smoothing on the f characteristic of the entire frequency band at a 1/12 octave width. In FIGS. 4A and 4B, an average f characteristic 401 before correction in the low frequency band serving as the target of sound field correction is indicated by a thick dotted line.

In step S202, the signal analysis processing unit 103 calculates the level difference between the low frequency band and the middle and high frequency bands on each f characteristic graph (two-dimensional graph defined by the frequency and the amplitude) of the entire frequency band shown in FIG. 3A. First, an average value in the range of the target frequency band of sound field correction is set as the level (level representing the low frequency band) of the f characteristic in the low frequency band. In FIG. 3A, the levels of respective f characteristics in the low frequency band are indicated by horizontal lines drawn in the target frequency band, and substantially overlap each other because normalization based on the level in the low frequency band has been performed in step S201.

A linear approximate straight line is calculated in consideration of the fact that the f characteristic in the middle and high frequency bands generally has a downward slope in accordance with the reverberation of the room. The target frequency band in which an approximate straight line is calculated has a lower limit of 200 Hz, which is the boundary frequency, and an upper limit of 10 kHz. As for the upper limit, for example, 20 kHz may be set in consideration of the human audibility range, the high frequency band reproduce capability of the speaker 115L or 115R, the high frequency band sound capture capability of the microphone 121, and the like. FIG. 3A shows the approximate straight line of each f characteristic in the target frequency band in the middle and high frequency bands. Although a linear approximate straight line is used for the approximate characteristic (level representing the middle and high frequency bands) of each f characteristic of the middle and high frequency bands, a higher-order approximate curve may be used.

Subsequently, a value at the boundary frequency of the approximate straight line in the middle and high frequency bands is subtracted from the level in the low frequency band for each of the total of nine f characteristics. This difference is defined as a level difference $\Delta i$ (i=1 to 9) of each f characteristic between the low frequency band and the middle and high frequency bands. The average of the level differences $\Delta i$ of the respective f characteristics is calculated as a representative level difference $\Delta$ between the low frequency band and the middle and high frequency bands. As for the f characteristic of the sound-producing pattern L+R, the level in the high frequency band is sometimes greatly disturbed owing to the interference between left and right, and influences the approximate straight line in the middle and high frequency bands. To solve this, the f characteristic of the sound-producing pattern L+R may be removed or the weight may be decreased in averaging of the level differences $\Delta i$.

Figure 5A:
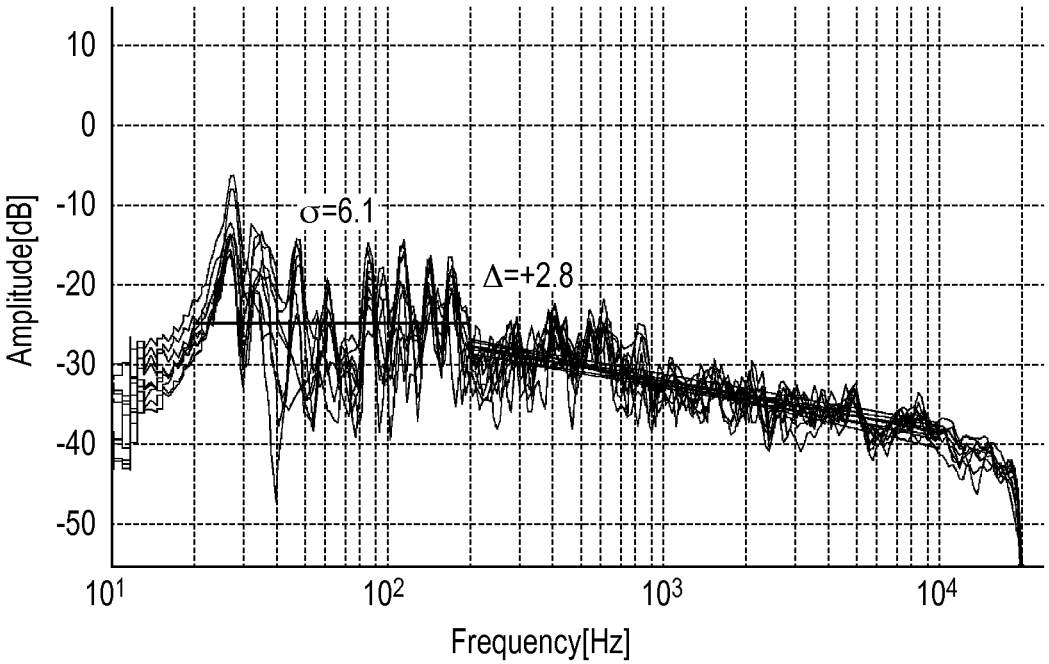
FIGS. 5A and 5B are graphs for explaining the balance of the f characteristic between the low frequency band and the middle and high frequency bands in given room A.
Figure 5B:
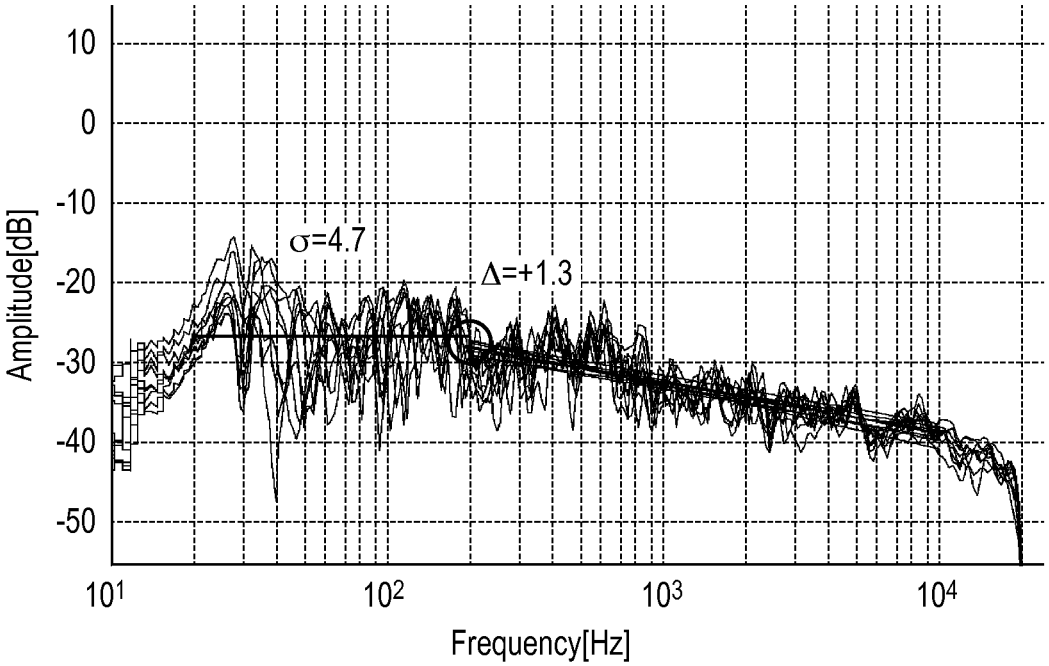
Figure 6:
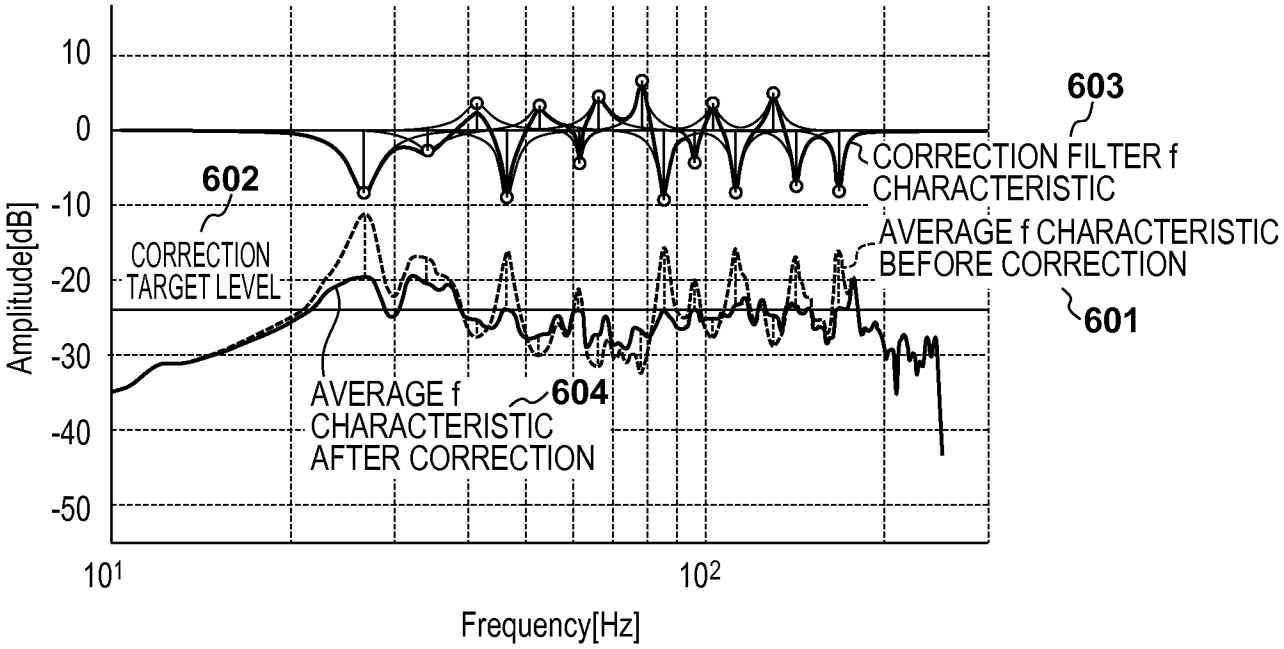
FIG. 6 is a graph for explaining an example of the design of a sound field correction filter in given room A.

As represented near the boundary frequency in FIG. 3A, the level difference between the low frequency band and the middle and high frequency bands before sound field correction in room B is $\Delta$=+6.7, which is much larger than $\Delta$=+2.8 in room A shown in FIG. 5A. This is because a steep step is generated between the low frequency band and the middle and high frequency bands in room B, unlike room A, and the level in the low frequency band is much higher than that in the middle and high frequency bands, as indicated by a circled portion in FIG. 3A. It is considered that as the absolute value of $\Delta$ becomes larger, the balance between the low frequency band and the middle and high frequency bands becomes poorer, and the audibility is impaired.

In step S203, the signal analysis processing unit 103 decides, based on the level difference calculated in step S202, the correction target level (level of the target characteristic) of the average f characteristic 401 before correction that has been calculated in step S201.

In general sound field correction, the average level of an average f characteristic 401 before correction is set as a correction target level 402, as indicated by a horizontal line in FIG. 4A, and peaks and dips on the average f characteristic 401 before correction are suppressed toward the correction target level 402. However, the average level of the average f characteristic 401 before correction basically corresponds to the level of each f characteristic in the low frequency band as shown in FIG. 3A. For this reason, even if correction is performed toward the correction target level 402, the level of each f characteristic in the low frequency band hardly changes, and the large level difference $\Delta$ between the low frequency band and the middle and high frequency bands remains even after sound field correction.

Thus, as shown in FIG. 4B, the correction target level 402 is offset by $-\Delta$ obtained by inverting the sign of the level difference $\Delta$ in FIG. 3A, and this offset level is set as an offset correction target level 412. By performing correction toward the offset correction target level 412, the large level difference $\Delta$ between the low frequency band and the middle and high frequency bands is canceled.

Note that the average level of the f characteristic does not always become the correction target level after sound field correction, and slightly varies from the correction target level in accordance with the balance between peaks and dips to be actually corrected. The range of the examination indicates that the average level tended to be slightly lower than the correction target level. Thus, for example, about 1 dB may be added to the offset amount that is a value obtained by inverting the sign of the level difference Δ.

The correction target level need not always be offset, and may not be offset on the assumption that no problem occurs in audibility as long as the absolute value of the level difference Δ is equal to or smaller than a predetermined value. The audition experiment reveals that when the absolute value of Δ exceeded about 3 dB, deterioration of the audibility was sensed, and when it exceeded 6 dB, the audibility was greatly impaired. A change of the audibility was sensed at about 1 dB. Therefore, by setting the predetermined value to be 3 dB, the offset can be omitted because the level difference in room A shown in FIG. 5A is Δ=+2.8.

In step S204, the signal analysis processing unit 103 generates a sound field correction filter by using the results of the preceding steps.

First, peaks and dips on the average f characteristic 401 before correction are detected. As for a peak, for example, an error curve is set by subtracting the offset correction target level 412 from the average f characteristic 401 before correction. A point at which the sign of an adjacent difference in the frequency direction changes from a positive to a negative and the value of the error curve is positive is detected as a peak. The value of the error curve at this time is set as the positive gain of the peak. Similarly, as for a dip, a point at which the sign of an adjacent difference in the frequency direction of the error curve changes from a negative to a positive and the value of the error curve is negative is detected as a dip. The value of the error curve at this time is set as the negative gain of the dip. Since the target frequency band of sound field correction is 20 to 200 Hz, it is only necessary to detect peaks and dips in this frequency range. Note that the target frequency band defined in step S201 may be decided based on the result of detecting peaks and dips similar to those described above from the f characteristic of each impulse response before averaging.

The detected peaks and dips on the average f characteristic 401 before correction generally have a steep shape for the f characteristic. As a filter for canceling (sound field correction) steep peaks and dips, for example, a biquadratic IIR peak filter capable of implementing a steep filter characteristic by a small processing amount is used. More specifically, peak filters that set negative and positive filter gains are assigned to respective peaks and dips in order to cancel the positive and negative gains of the peaks and dips. At this time, the bandwidth or Q of a corresponding peak filter is also set in accordance with a bandwidth representing the spread of each peak/dip in the frequency direction, or Q representing steepness.

If an optimization problem that minimizes the area of the error curve is formulated, the set parameter of the peak filter can be optimized without describing processes such as peak/dip detection and bandwidth calculation. All detected peaks and dips need not be corrected, and small peaks and dips that do not influence the audibility may be ignored. For example, the condition of a peak/dip to be corrected may be that the absolute value of the gain is equal to or larger than a predetermined value (for example, 3 dB), or that an area triangle-approximated by the bandwidth and the gain absolute value is equal to or larger than a predetermined value.

In this case, the offset correction target level 412 obtained by downward offset, as shown in FIG. 4B, is used, so only peaks on the average f characteristic 401 before correction are correction targets, and a total of 12 peak filters having negative filter gains are generated to suppress these peaks. All the generated peak filters are series-connected into an overall sound field correction filter, and the overall sound field correction filter has a correction filter f characteristic 413 indicated by a thick solid line. The correction filter f characteristic 413 is applied to the average f characteristic 401 before correction, obtaining an average f characteristic 414 after correction (frequency characteristic after correction).

Figure 3B:
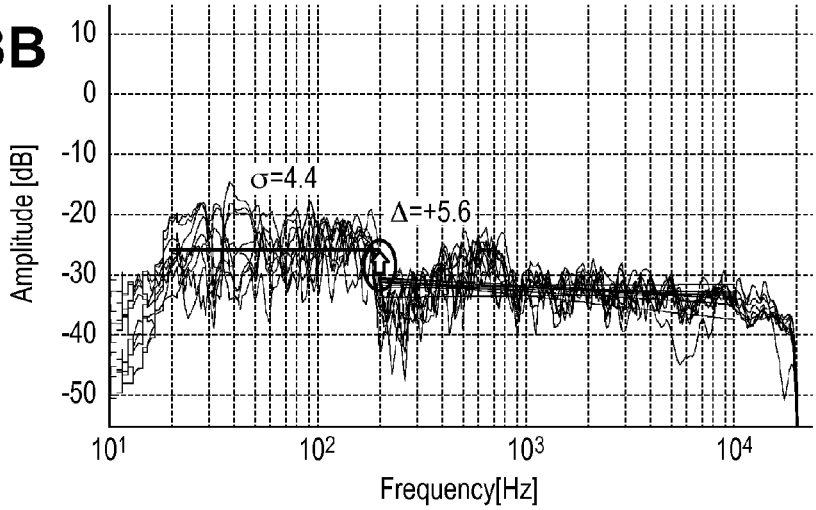
Figure 3C:
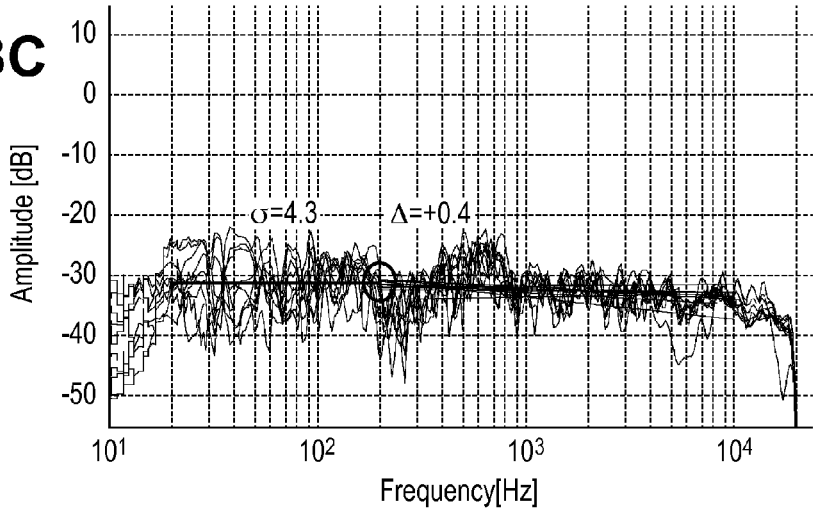

The correction filter f characteristic 413 is applied to each f characteristic in FIG. 3A, obtaining each f characteristic in FIG. 3C. The steep step between the low frequency band and the middle and high frequency bands is canceled by the large negative correction amount of the correction filter f characteristic 413 and the steep characteristic of the peak filter near the boundary frequency. As a result, even the level difference A changes from +6.7 before correction to +0.4, and the horizontal line of the average level in the low frequency band and the approximate straight line in the middle and high frequency bands are smoothly connected, as indicated by the circled portion.

The standard deviations of the respective f characteristics are calculated within the target frequency band in the low frequency band, and the average value of them is defined as σ and indicated at a low frequency band portion. σ is one index representing the flatness of the f characteristic in the low frequency band, and the value becomes larger as the numbers of peaks and dips on the f characteristic become larger. σ also changes from 5.0 before correction to 4.3. This indicates that peaks and dips on the f characteristic in the low frequency band are suppressed by sound field correction. Compared to FIG. 3B in the case in which the correction target level 402 not to be offset, the level difference between the low frequency band and the middle and high frequency bands is canceled while peaks and dips on each f characteristic are suppressed by the same amount or more. As a result of further conducting an audition experiment, the audibility was greatly impaired in the state of FIG. 3B in which the balance between the low frequency band and the middle and high frequency bands is poor, but good audibility was obtained in the state of FIG. 3C in which the balance is good.

In this way, by offsetting the correction target level in the low frequency band in accordance with the level difference between the low frequency band and the middle and high frequency bands, suppression of peaks and dips on the f characteristic in the low frequency band and cancellation of the level difference can be implemented simultaneously. At this time, a peak filter having a steep characteristic is used for correction of peaks and dips, so even a steep step between the low frequency band and the middle and high frequency bands can be canceled. A case in which the level in the low frequency band is much higher than that in the middle and high frequency bands has been exemplified. However, even when the level in the low frequency band is much lower than that in the middle and high frequency bands, the level difference can be similarly canceled by offsetting upward the correction target level.

It is expected that a step can be clearly canceled by making the boundary frequency defined in step S201 coincide with a frequency at which a steep step is generated on each f characteristic. It is therefore possible to select a plurality of boundary frequency candidates in, for example, a Schroeder frequency range of 100 Hz to 1 kHz in a general room, calculate the level difference between the low frequency band and the middle and high frequency bands for each candidate, and employ, as the frequency at the step, a boundary frequency at which the level difference becomes maximum.

In actual processing, a level difference after sound field correction may not always be calculated. However, to more reliably cancel the level difference, the following processing may be performed. That is, the process returns again to step S202 after step S204 to enter the loop of the second cycle, and calculate a level difference from each f characteristic after the application of the sound field correction filter. If the absolute value of this value is equal to or smaller than the above-described predetermined value at which a problem in audibility occurs, the process may escape from the loop at that time.

However, if the absolute value exceeds the predetermined value, the offset amount used in the first cycle is modified again in step S203 in consideration of the level difference calculated in the second cycle, acquiring the offset correction target level of the second cycle. Then, the sound field correction filter is designed again in step S204 based on the offset correction target level of the second cycle. This loop is repeated until a level difference (level difference after correction) after the application of the sound field correction filter is appropriately compared with the predetermined value, the level difference becomes equal to or smaller than the predetermined value, and the process can escape from the loop.

The filter coefficient of the peak filter constituting the sound field correction filter is stored in the storage unit 102, and applied to a reproduce signal by the filter apply unit 113R or 113L in subsequent processing of the reproduce system that is performed upon selecting the reproduce signal input unit 111.

As described above, according to this embodiment, the correction target level in the low frequency band is controlled to cancel a level difference between the low frequency band and the middle and high frequency bands in sound field correction, thereby obtaining good audibility in which the low frequency band and the middle and high frequency bands are balanced, while suppressing peaks and dips on the f characteristic in the low frequency band.

Note that the embodiment has exemplified a stereo system, but the present invention is not limited to this. The present invention is easily applicable to, for example, even a multi-channel system such as a 5.1ch surround system.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-008856, filed Jan. 21, 2014, which is hereby incorporated by reference wherein in its entirety.

What is claimed is:

1. A sound field correction apparatus that corrects influence of interference between a plurality of sound waves on a frequency characteristic in an acoustic space to obtain a target characteristic, comprising:

one or more processors; and one or more memories storing instructions, which, when executed by the one or more processors, cause the sound field correction apparatus to:

measure an impulse response between a sound-producing source and a listening point in the acoustic space;

derive, from the impulse response, a frequency characteristic serving as a processing target of sound field correction;

calculate a level difference at a boundary frequency between a level representing a low frequency band and a level representing middle and high frequency bands for the low frequency band not higher than the boundary frequency and the middle and high frequency bands higher than the boundary frequency in the frequency characteristic; and decide a level of a target characteristic in the low frequency band in the frequency characteristic to set the level difference after sound field correction to be not larger than a predetermined value.

2. The apparatus according to claim 1, wherein the one or more memories store further instructions which, when executed by the one or more processors, cause the sound field correction apparatus to calculate the level difference from the frequency characteristic expressed by a two-dimensional graph defined by a logarithmic frequency and an amplitude, wherein the predetermined value falls within a range of 1 dB to 6 dB with respect to 3 dB serving as a basis.

3. The apparatus according to claim 1, wherein sound field correction of a peak and dip in the low frequency band is performed using a biquadratic IIR peak filter.

4. The apparatus according to claim 1, wherein the boundary frequency falls within a range of 100 Hz to 1 kHz with respect to 200 Hz serving as a basis.

5. The apparatus according to claim 1, wherein the boundary frequency is decided to maximize the level difference.

6. The apparatus according to claim 1, wherein the one or more memories store further instructions, which, when executed by the one or more processors, cause the sound field correction apparatus to decide a target frequency band of the sound field correction in accordance with the at least one of reproduce capability of the sound-producing source and sound capture capability of the listening point.

7. The apparatus according to claim 1, wherein the one or more memories store further instructions, which, when executed by the one or more processors, cause the sound field correction apparatus to, when a plurality of impulse responses is measured, derive, as the frequency characteristic serving as the processing target, a frequency characteristic obtained by weighting and averaging frequency characteristics derived from the respective impulse responses.

8. The apparatus according to claim 1, wherein the one or more memories store further instructions, which, when executed by the one or more processors, cause the sound field correction apparatus to, when a plurality of impulse responses is measured, calculate, as a level difference to be compared with the predetermined value, an average value of level differences regarding frequency characteristics derived from the respective impulse responses.

9. The apparatus according to claim 1, wherein the one or memories store further instructions, which, when executed by the one or more processors, cause the sound field correction apparatus to, when the level difference regarding a frequency characteristic after correction obtained by applying, to the frequency characteristic, a sound field correction filter designed based on the level of the target characteristic exceeds the predetermined value, modify the level of the target characteristic until the level difference becomes not larger than the predetermined value.

10. A method of controlling a sound field correction apparatus that corrects influence of interference between a plurality of sound waves on a frequency characteristic in an acoustic space to obtain a target characteristic, comprising:

measuring an impulse response between a sound-producing source and a listening point in the acoustic space;

deriving, from the impulse response, a frequency characteristic serving as a processing target of sound field correction;

calculating a level difference at a boundary frequency between a level representing a low frequency band and a level representing middle and high frequency bands for the low frequency band not higher than the boundary frequency and the middle and high frequency bands higher than the boundary frequency in the frequency characteristic; and deciding a level of a target characteristic to set the level difference after sound field correction to be not larger than a predetermined value.

11. A non-transitory computer-readable storage medium storing instructions, which, when executed by one or more processors, cause a computer to function as a sound field correction apparatus that corrects the influence of interference between a plurality of sound waves on a frequency characteristic in an acoustic space to obtain a target characteristic, and cause the computer to:

measure an impulse response between a sound-producing source and a listening point in the acoustic space;

derive, from the impulse response, a frequency characteristic serving as a processing target of sound field correction;

calculate a level difference at a boundary frequency between a level representing a low frequency band and a level representing middle and high frequency bands for the low frequency band not higher than the boundary frequency and the middle and high frequency bands higher than the boundary frequency in the frequency characteristic; and decide a level of a target characteristic in the low frequency band in the frequency characteristic to set the level difference after sound field correction to be not larger than a predetermined value.

* * * * *